United States Patent [19]

Sanford

[11] 4,143,500

[45] Mar. 13, 1979

[54] END BEARING CONSTRUCTION FOR TRUSS

[76] Inventor: Arthur C. Sanford, 2308 Bay Dr., Hillsboro Shores, Pompano Beach, Fla. 33062

[21] Appl. No.: 885,952

[22] Filed: Mar. 13, 1978

[51] Int. Cl.[2] ..... E04C 3/12

[52] U.S. Cl. ..... 52/693

[58] Field of Search ..... 52/690–697; 85/13; 403/217

[56] References Cited

U.S. PATENT DOCUMENTS

| | | | |
|---|---|---|---|
| 3,416,283 | 12/1968 | Sanford | 52/693 |
| 3,498,170 | 3/1970 | Sanford | 85/13 |
| 3,531,904 | 10/1970 | Sanford | 52/693 X |
| 3,708,942 | 1/1973 | Leonard | 52/694 |
| 3,867,803 | 2/1975 | Platt | 52/693 |
| 3,985,459 | 10/1976 | Gilb | 403/217 |
| 4,031,686 | 6/1977 | Sanford | 52/693 |

*Primary Examiner*—J. Karl Bell

*Attorney, Agent, or Firm*—Hamilton, Renner & Kenner

[57] ABSTRACT

A bearing construction for the end of a flat truss having top and bottom wood chord members and inclined metallic intervening tension web members terminating in apertured load transfer flanges secured to at least one side of the chord members by toothed connector plates overlying the flanges with the teeth intermeshing the apertures and embedded in the chord members. A stress transferring channel overlies the end of the top chord and the channel web has teeth embedded into the top of the chord. The legs of the channel abut the sides of the chord under the flanges and connector plates and are apertured to intermesh with connector plate teeth extending through the load transfer flanges into the sides of the chord.

8 Claims, 7 Drawing Figures

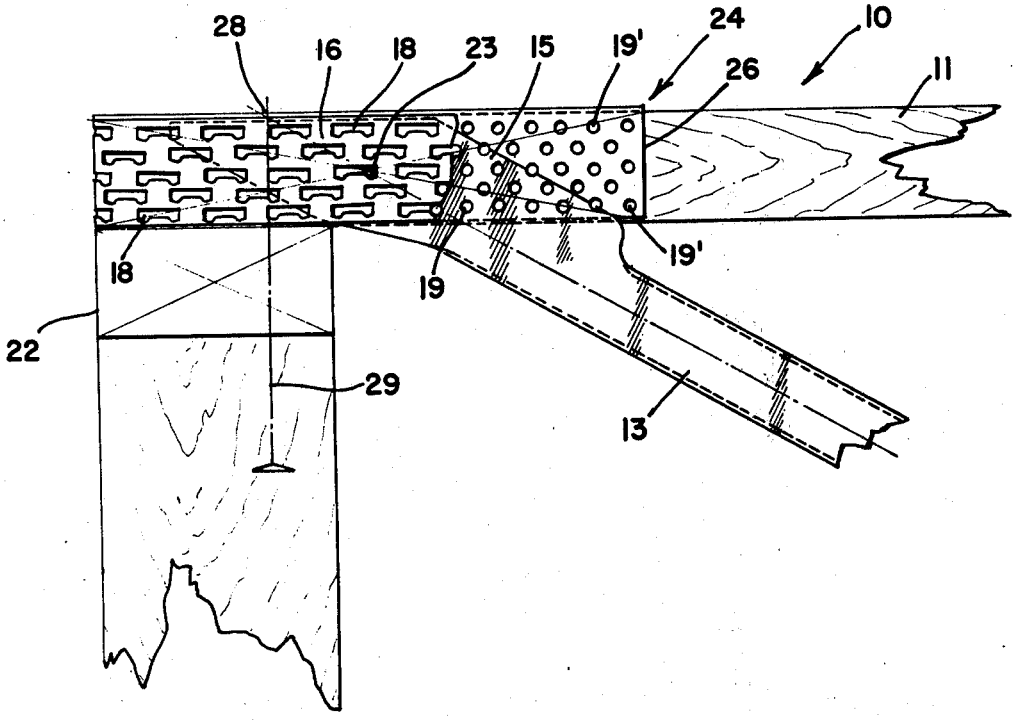

END BEARING CONSTRUCTION FOR TRUSS

BACKGROUND OF THE INVENTION

The present invention relates to improvements in the construction of the type of truss shown in my prior U.S. Pat. No. 3,416,283 which discloses parallel top and bottom wood chord members and diagonal metal compression and tension web members having perforated load transferring flanges at their ends connected to the sides of the chord members by toothed plates abutting the flanges with the teeth intermeshing the flange perforations and embedded in the wood chords. A modification of this type of truss is shown in my prior U.S. Pat. No 4,031,686, wherein wood compression web members are used alternately with metallic tension web members.

In both constructions the ends of the upper chord at the bearing supports where the greatest stresses occur are connected to diagonal metallic tension web members secured to one or both sides of the chord by toothed plates, and the centroid of each side plate where the stress is concentrated is spaced laterally from the bearing support creating eccentric loading or moment, which causes increased bending and compression stress in the top chord. With longer spans such increased stress may result in failure of the top chord. Prior attempts to correct this problem have included applying elongated steel strips to the top and bottom faces of the top chord, but this expedient results in excessive cost.

SUMMARY OF THE INVENTION

It is an object of the present invention to provide an improved bearing construction for the end of the top chord of a truss which transfers the concentration of stress to a point directly over the bearing support for the truss.

Another object is to provide an improved bearing channel which eliminates bending moment from the top chord of a truss carried on a bearing support.

A further object is to provide an improved bearing channel which cooperates with web members secured to the sides of the top chord of a truss to eliminate eccentric loading and moment on the top chord at the end bearing.

These and other objects are accomplished by the present invention, preferred embodiments of which are shown by way of example in the accompanying drawings and described in the following specification as constituting the best mode of carrying out the invention. Various modifications and changes in details of construction are comprehended within the scope of the appended claims.

DESCRIPTION OF PREFERRED EMBODIMENTS

Figure 1:
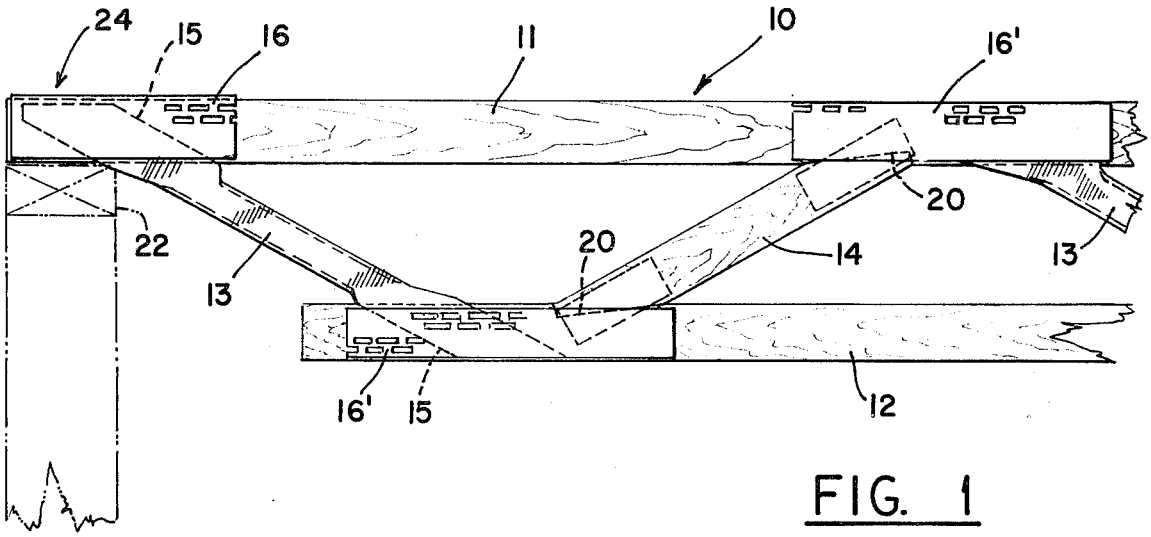
FIG. 1 is a side elevation of the end portion of a flat truss carried on a bearing support and embodying the present invention.

Referring to FIGS. 1–5, the truss arrangement designated generally by the numeral 10 has a top chord member 11 and a parallel bottom chord member 12 interconnected with diagonal web members 13 and 14. The chord members are of wood and the diagonal or inclined web members 13 are of metal while the web members 14 may be of wood. The truss shown is a Warren type truss designed so that web members 13 are subjected to tension stresses and the web members 14 are subjected to compression stresses, but the invention applies to other types of trusses.

The chord members 11 and 12 are preferably standard 2 × 4's with their wider faces opposing each other, so that their narrower faces are at opposite sides of the truss. The web members 13 may have a channel ribbed cross section with terminal flat load transfer flanges 15 for normally abutting one or both sides of the chord members, and toothed plates 16 and 16' overlie the flanges. The plates 16 and 16' preferably have staggered rows of teeth 17 bent in from the ends of slots 18 for penetration into the wood chords, and the flanges 15 each have a plurality of apertures 19 which may be circular, and are arranged in a pattern so as to intermesh with at least a number of the teeth, thereby securing the flanges 15 to the sides of the chords.

The design and pattern of the teeth may be according to the teeth shown in my prior U.S. Pat. No. 3,416,283, although other tooth designs and patterns may be used. The exact configuration of the apertures 19 is not critical as long as the teeth intermesh with their edges in tight engagement with the edges of the apertures so as to maintain the web member fixed with respect to the chord member to which it is secured, when the truss is under load.

In the truss shown, the wood web members 14 may have their ends beveled for fitting in oppositely disposed triangular notches 20 in the inner opposing faces of the chords 10 and 11 in accordance with the truss construction disclosed in my prior U.S. Pat. No. 4,031,686, and the notches are overlaid on one side by the toothed plates 16' connecting the terminal flanges of the metal web connectors 13 to the chords. The notches may be overlaid on the other side by smaller toothed plates which connect the web members 14 to the chords.

Figure 2:
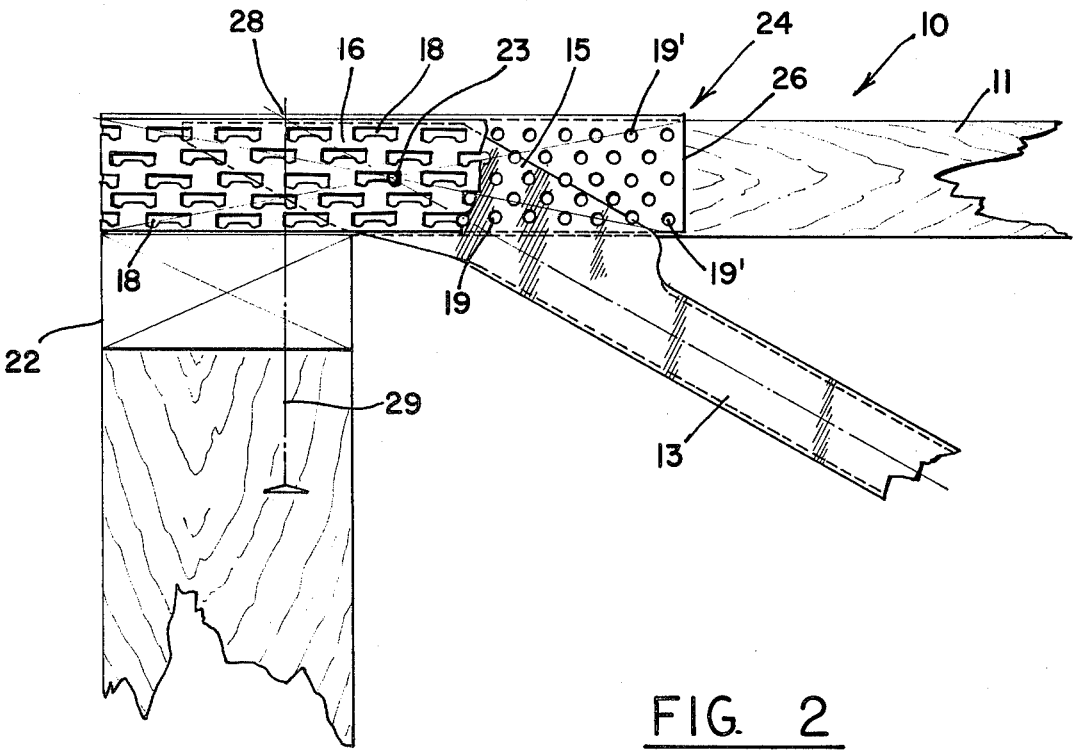
FIG. 2 is an enlarged view of the end portion of the truss shown in FIG. 1.
Figure 3:
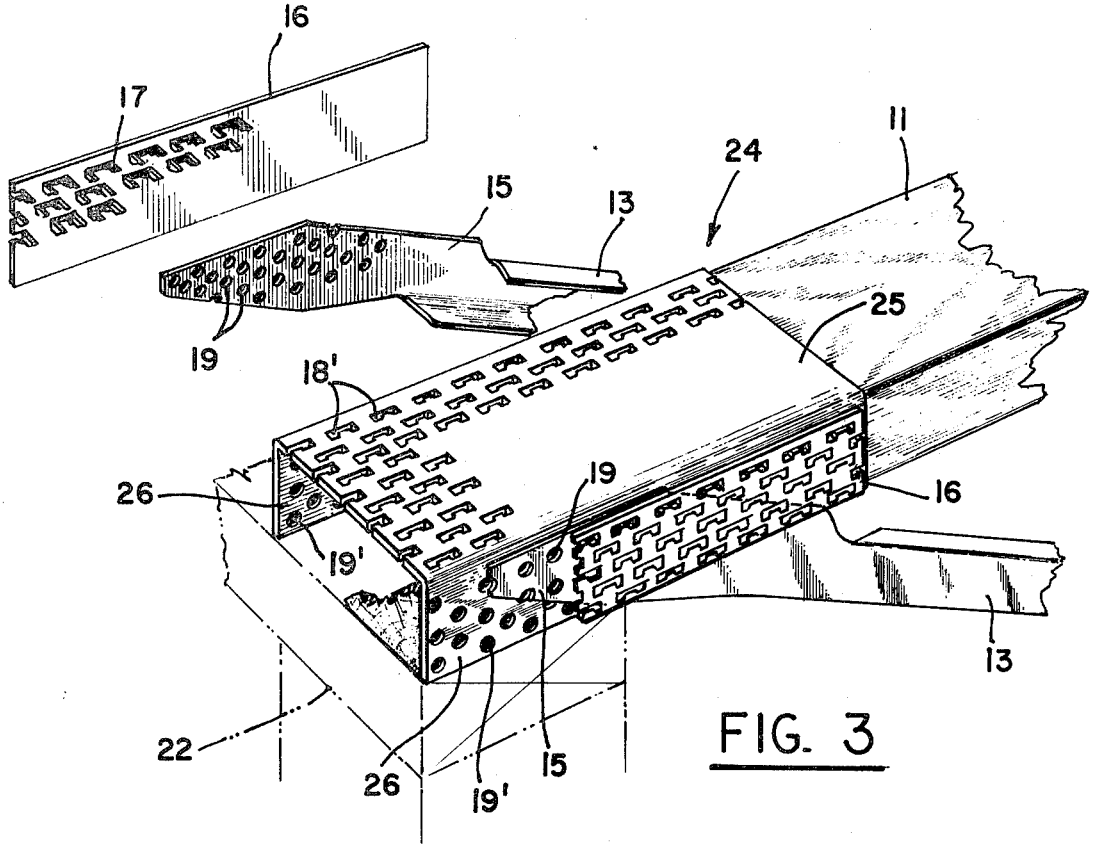
FIG. 3 is a partially exploded perspective view of the improved end bearing construction.
Figure 4:
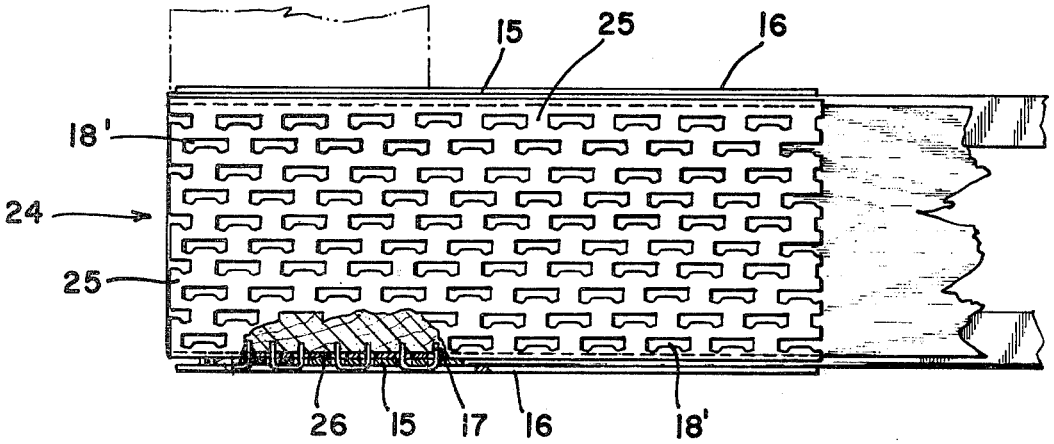
FIG. 4 is a plan view of the construction of FIG. 2.
Figure 5:
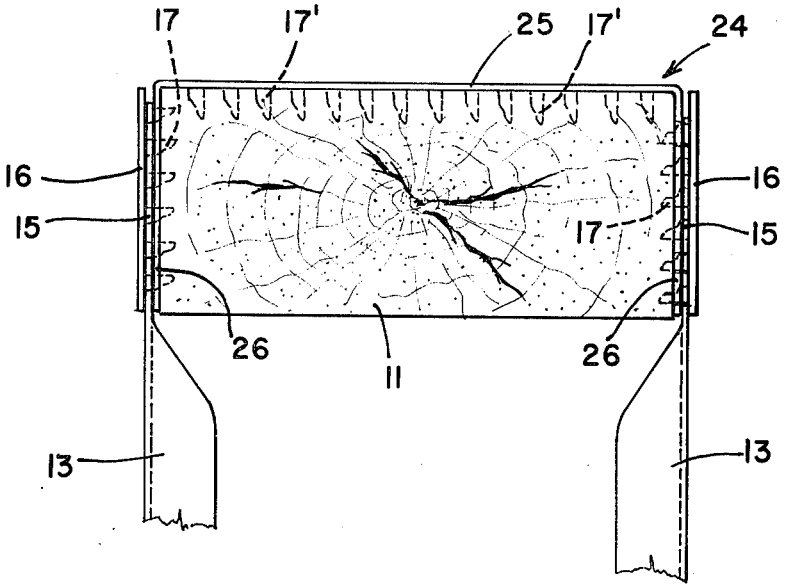
FIG. 5 is an end view thereof.

Each end of the top chord of the truss is carried on a bearing support 22, one end being shown in FIGS. 1 and 2, the opposite end of the chord being supported in identical fashion. The side toothed plates 16 securing the end portion of the top chord to the end tension web member or members 13 preferably extend across the full width of the support. It may be desirable to have a web tension member 13 on each side of the truss secured to the chords by toothed plates 16, as shown in FIG. 5.

As seen in FIG. 2, the centroid 23 of each toothed plate, which is equivalent to a pin connection, is at the point where the stress is concentrated at the intersection of the centerline of the web member 13 and the horizontal centerline of the plate 16, and this point is laterally offset from the bearing support so that the reaction therefrom would normally cause a bending moment and eccentric loading on the top chord of the truss.

The present invention constitutes securing an inverted metal channel 24 to the end portion of the top chord 11, said channel being coextensive with the side plates 16. Teeth 17' bent in from slots 18' are provided throughout the entire area of the upper web 25 of the channel 24, and these teeth are fully embedded into the top of chord 11 so as to prevent any relative movement of the channel under load. The depending legs 26 of the channel underlie the load transferring flanges 15 of the web members 13 and have apertures 19' of the same shape and pattern as the apertures 19 so that the teeth 17 of the side plates will intermesh both the apertures 19 and 19' and penetrate into the sides of chord 11, thus holding the channel legs 26 against any relative movement on the chord.

As shown in FIG. 2, the improved construction provides means for transferring the stresses from centroid 23 along the centerline of web member 19 into the channel web 25 at point 28 directly above the bearing support 22, so that the reaction force acts along vertical line 29, and moment or eccentric loading is obviated.

Figure 6:
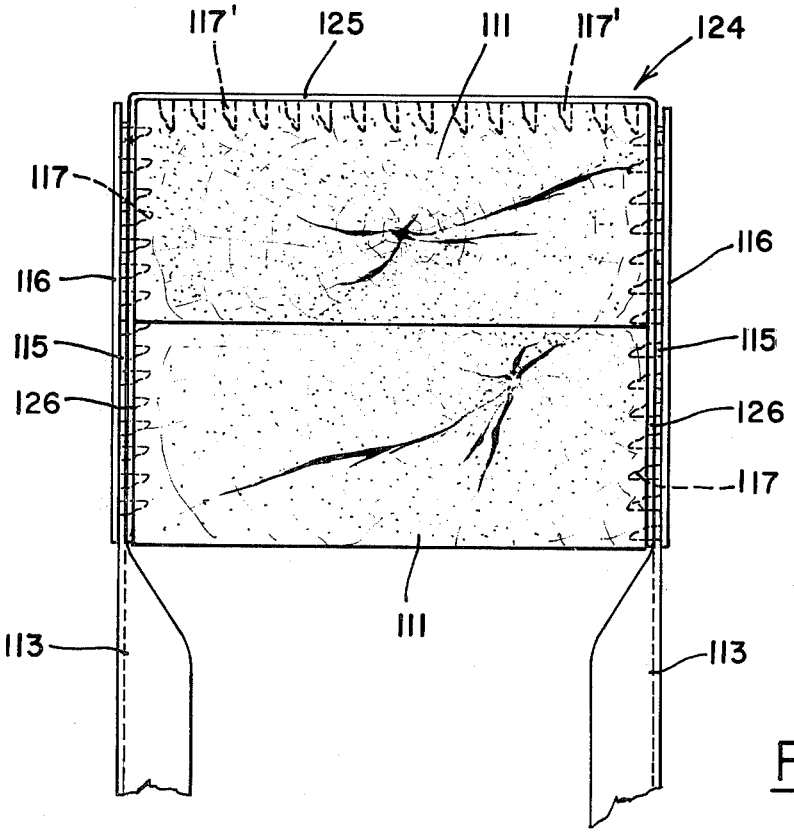
FIG. 6 is a similar view of another embodiment having two superposed top chords.
Figure 7:
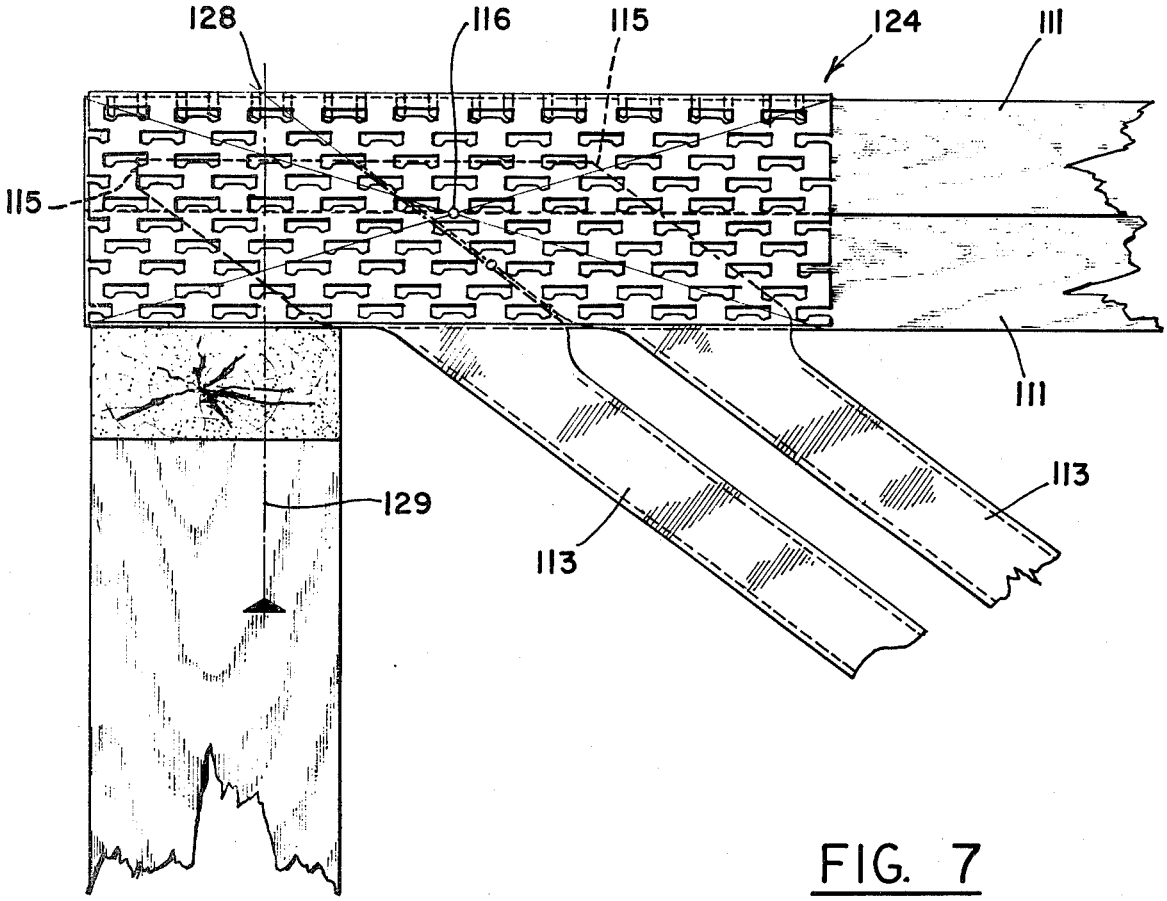
FIG. 7 is an enlarged side view of the construction of FIG. 6.

In the embodiment of FIGS. 6 and 7, the upper chord of the truss comprises two superposed chords 111, the sides of which are traversed by toothed side plates 116 overlying the flat terminal apertured flanges 115 of two side-by-side metal web members 113. The apertured side legs 126 of the inverted channel 124 are coextensive with plates 116 and underlie the flanges 115 so that the teeth 117 of the plates 116 intermesh with the apertures in the flanges 115 and the legs 126. The web 125 of the channel 124 has teeth 117' embedded into the top of the upper chord 111.

In this construction the web members 113 are inclined at a greater angle to the chords to accommodate a truss of greater depth than in FIG. 2, and the centroid is on an inclined centerline midway between the web members. Thus the stresses are transferred upwardly along the centerline and into the channel web 125 at point 128 which is directly above the bearing support 122 along vertical reaction line 129.

It will be apparent that a simple, economical and efficient bearing construction for the end of the top chord of a truss has been provided for obviating the bending moment and consequent stresses normally due to excentric loading on the truss bearing support.

What is claimed is:

1. In combination, a truss having top and bottom chord members and intervening web members, a bearing support for the end of the truss, an inclined metallic web connector having an apertured terminal flange contiguous to the side of the end portion of the top chord, and a side connector plate overlying said flange and extending over said bearing support, said side connector plate having teeth intermeshing said flange apertures and embedded in said chord, a channel bearing plate having a toothed web with its teeth embedded in the top of said top chord, and apertured legs depending from said web abutting the sides of said top chord under said apertured terminal flange and intermeshing with the teeth of said side connector plate.

2. In combination, a truss as described in claim 1, wherein the channel bearing plate is coextensive with said side connector plate.

3. In combination, a truss as described in claim 1, wherein the truss has two superposed top chord members, and the side connector plate and underlying channel legs traverse the sides of both top chord members.

4. In combination, a truss as described in claim 3, wherein there are two parallel side-by-side metallic web connectors with terminal apertured flanges overlaid by the side connector plate.

5. Bearing plate construction for the end of a top wood chord of a truss, comprising an inclined web connector having an apertured terminal flange contiguous to the side of the end portion of said top chord, a toothed side connector plate overlying said flange and having teeth intermeshing said apertures and embedded in said chord, a channel bearing plate having a toothed web with its teeth embedded in the top of said chord, and apertured legs depending from said web abutting the sides of said chord under said terminal flange and intermeshing the teeth of said side flange.

6. Bearing plate construction as described in claim 5, wherein the channel bearing plate is coextensive with said side connector plate.

7. Bearing plate construction as described in claim 5, wherein there are two superposed top chord members, and the side connector plate and underlying channel legs traverse the sides of both chord members.

8. Bearing plate construction as described in claim 7, wherein there are two parallel side-by-side tension web connectors with terminal flanges overlaid by the side connector plate.

* * * * *